US009193576B2

(12) United States Patent
Nighy

(10) Patent No.: US 9,193,576 B2
(45) Date of Patent: Nov. 24, 2015

(54) BEVERAGE DISPENSER

(71) Applicant: CORNELIUS, INC., St. Paul, MN (US)

(72) Inventor: Richard John Nighy, Stratford Upon Avon (GB)

(73) Assignee: Cornelius, Inc., St. Paul, MN (US)

( * ) Notice: Subject to any disclaimer, the term of this patent is extended or adjusted under 35 U.S.C. 154(b) by 401 days.

(21) Appl. No.: 13/693,907

(22) Filed: Dec. 4, 2012

(65) Prior Publication Data

US 2013/0092282 A1 Apr. 18, 2013

Related U.S. Application Data

(60) Division of application No. 13/099,592, filed on May 3, 2011, now Pat. No. 8,327,607, which is a continuation of application No. 12/448,839, filed as application No. PCT/GB2008/000079 on Jan. 9, 2008, now abandoned.

(30) Foreign Application Priority Data

| | | |
|---|---|---|
| Jan. 9, 2007 | (GB) | 0700317.1 |
| Jun. 21, 2007 | (GB) | 0711966.2 |
| Oct. 8, 2007 | (GB) | 0719575.3 |

(51) Int. Cl.
*B67D 1/00* (2006.01)
*B65B 3/04* (2006.01)
(Continued)

(52) U.S. Cl.
CPC ..... *B67D 1/0037* (2013.01); *B65B 3/045* (2013.01); *B65D 75/5872* (2013.01);
(Continued)

(58) Field of Classification Search
CPC ..... B65B 3/045; B65B 3/12; B65B 3/10; B65B 3/17; B65B 37/06; B67D 1/0021; B67D 1/0037; B67D 1/0045; B67D 1/0022; B67D 1/0031; B67D 1/0044; B67D 1/0048; B67D 1/0079; B67D 1/0888; B67D 1/1231; B67D 1/1234; B67D 1/1243; B67D 2001/082; B65D 81/3222; B65D 75/5872
USPC ..... 53/469, 410, 471, 133.2, 284.7, 281; 141/2, 9, 100, 104, 301, 302; 222/1, 222/129–129.4, 132, 135, 165, 105, 107, 222/95, 94, 185.1, 145.5, 145.6, 325, 328, 222/389
See application file for complete search history.

(56) References Cited

U.S. PATENT DOCUMENTS

| | | | | |
|---|---|---|---|---|
| 3,566,930 | A | 3/1971 | Kirschne | |
| 3,596,430 | A * | 8/1971 | Parish | 53/67 |

(Continued)

FOREIGN PATENT DOCUMENTS

| | | |
|---|---|---|
| EP | 0 752 897 | 2/2002 |
| EP | 1295844 A1 | 3/2003 |

(Continued)

*Primary Examiner* — Thanh Truong
*Assistant Examiner* — Joy N Sanders
(74) *Attorney, Agent, or Firm* — Andrus Intellectual Property Law, LLP

(57) ABSTRACT

A method of dispensing a beverage includes the steps of: providing a housing having a plurality of reservoirs of beverage concentrate each reservoir having a concentrate pump and flexible conduit terminating in a nozzle; providing a plurality of drivers driving said concentrate pumps; providing diluent to the pumped concentrate to produce a beverage; providing a multiple dispense head accepting the plurality of nozzles; selecting a flexible pouch and bringing it into alignment with a nozzle in a filling position where it is filled via an opening; closing said opening and dispensing said filled sealed flexible pouch; wherein the filling position is a fixed position and wherein said nozzles are movable relative to the filling position such that any one of said plurality of nozzles can be presented at said filling position.

16 Claims, 6 Drawing Sheets

(51) Int. Cl.
*B65D 75/58* (2006.01)
*B67D 1/08* (2006.01)
*B67D 1/12* (2006.01)

(52) U.S. Cl.
CPC ..... *B67D 1/0022* (2013.01); *B67D 1/0031* (2013.01); *B67D 1/0044* (2013.01); *B67D 1/0048* (2013.01); *B67D 1/0079* (2013.01); *B67D 1/0888* (2013.01); *B67D 1/1231* (2013.01); *B67D 1/1234* (2013.01); *B67D 1/1243* (2013.01); *B67D 2001/082* (2013.01)

(56) References Cited

U.S. PATENT DOCUMENTS

| | | | | |
|---|---|---|---|---|
| 3,727,799 | A | 4/1973 | Nixon | |
| 3,813,845 | A | 6/1974 | Weikert | |
| 4,386,636 | A | 6/1983 | Ellert | |
| 4,480,969 | A | 11/1984 | Credle, Jr. | |
| 4,964,261 | A | 10/1990 | Benn | |
| 5,088,515 | A | 2/1992 | Kamen | |
| 5,305,809 | A * | 4/1994 | Pringle | 141/235 |
| 5,344,292 | A | 9/1994 | Rabenau et al. | |
| 5,425,402 | A * | 6/1995 | Pringle | 141/235 |
| 5,664,399 | A | 9/1997 | Cassou | |
| 5,725,125 | A | 3/1998 | Bassette et al. | |
| 5,727,609 | A | 3/1998 | Knight et al. | |
| 5,797,519 | A | 8/1998 | Schroeder et al. | |
| 5,803,320 | A | 9/1998 | Cutting et al. | |
| 5,875,930 | A | 3/1999 | Nakajima et al. | |
| 5,992,685 | A | 11/1999 | Credle, Jr. | |
| 6,358,545 | B1 | 3/2002 | Chandler et al. | |
| 6,412,523 | B2 | 7/2002 | Brozell et al. | |
| 6,726,062 | B2 | 4/2004 | Segiet | |
| 7,004,355 | B1 | 2/2006 | Crisp et al. | |
| 7,089,973 | B2 | 8/2006 | Nicodem et al. | |
| 2002/0182090 | A1 | 12/2002 | Gray | |
| 2003/0168472 | A1 | 9/2003 | Segiet | |
| 2005/0121099 | A1 | 6/2005 | Hansen et al. | |
| 2006/0097009 | A1 | 5/2006 | Bethuy et al. | |
| 2006/0249536 | A1 | 11/2006 | Hartman et al. | |

FOREIGN PATENT DOCUMENTS

| | | | | |
|---|---|---|---|---|
| GB | 2416757 | | 2/2006 | |
| GB | 2548856 | | 10/2009 | |
| WO | 92/22493 | | 12/1992 | |
| WO | 97/47556 | | 12/1997 | |
| WO | 01/81238 | A1 | 11/2001 | |
| WO | WO 2005070816 | A1 * | 8/2005 | B67D 1/00 |
| WO | WO 2005071267 | A1 * | 8/2005 | F04B 43/00 |
| WO | 2006/097724 | | 9/2006 | |

* cited by examiner

BEVERAGE DISPENSER

RELATED APPLICATIONS

This is a divisional application of application Ser. No. 13/099,592 filed on May, 3, 2011 which is a continuation of application Ser. No. 12/448,839 having a filing date of Feb. 16, 2010 which claims priority to PCT/GB2008/000079 having an International filing date of Jan. 9, 2008, and are herein incorporated by reference.

BACKGROUND OF THE INVENTION

Traditionally there are two types of beverage dispensers, those which dispense a beverage into an open drinking receptacle and those which dispense a pre-closed container of beverage, for example a can, commonly known as beverage vending machines.

Beverage dispensers which produce a beverage from a concentrate and a diluent are advantageous in that they require only shipping of concentrate, not of diluted beverage. These type of dispensers are known to dispense a variety of beverages from different concentrates. These machines typically either have one dispense nozzle per beverage or have a single nozzle and the user manually places a cup under said nozzle.

In some circumstances it is desirable to locally produce a beverage, package it in a closed container, and then dispense the container containing the beverage. Such machines are generally limited to a single product, e.g. water, and do not offer the variety of product demanded by customers. To do so would either require a complex positional mechanical solution to place a packet under the desired dispense nozzle or alternatively use a common nozzle. Any miss alignment of package and nozzle will result in spillages inside the machine where they are not visible and could possibly sit for some time before being cleaned. Furthermore, the use of a common nozzle is undesirable due to cross contamination of flavours.

In addition, in such a vending machine application the parts of the machine used to produce the beverage are not easily cleaned as they are generally enclosed within the machine which is only opened by a service engineer resulting in a machine that is hard to maintain in a clean and safe condition.

It is the purpose of the present invention to provide a sanitary beverage dispenser for filling and dispensing containers of different flavoured beverage.

SUMMARY OF THE INVENTION

According to a first aspect of the invention there is provided an apparatus for introducing a selected beverage into a container, sealingly closing said container and dispensing said closed container, the apparatus comprising:

a housing adapted to, in use, accept a plurality of containers of beverage concentrate each container having a concentrate pump and flexible conduit, terminating in a nozzle, associated therewith, a plurality of drivers adapted to drive said concentrate pumps; a means of, in use, introducing diluent to the pumped concentrate to produce a beverage; a multiple dispense head for accepting the plurality of nozzles; a means for, in use, selecting a flexible pouch and bringing it into alignment with a nozzle in a filling position where it is filled via an opening therein; and a means for, in use, sealingly closing said opening and dispensing said filled sealed flexible pouch from said apparatus, wherein the filling position is a fixed position and, in use, said nozzles are movable relative to the filling position such that any of said plurality nozzles can be presented at said filling position.

The pump and drive and driver constructions are set forth and shown in PCT/GB2008/000080 having an International filing date of Jan. 9, 2008 and for which a National Stage application was filed on the same date as the present application and which PCT and U.S. National Stage application is hereby incorporated by reference as if fully set forth herein.

Preferably, in use, the multiple dispense head maintains the nozzles in an array.

In a first preferred arrangement, in use, the multiple dispense head maintains the nozzles in a linear array and the apparatus is provided with means for linearly indexing said multiple dispense head so as to, in use, present the nozzle associated with the required beverage above the opening in the flexible pouch.

According to a second preferred arrangement, in use, the multiple dispense head maintains the nozzles in a circular or radial array and the apparatus is provided with means for radially indexing said multiple dispense head so as to, in use, present the nozzle associated with the required beverage above the opening in the flexible pouch.

According to a third preferred arrangement, in use, the nozzles associated with each mixed beverage are maintained in a horizontal array, and the apparatus is provided with means to move each nozzle in both the horizontal and vertical axis from its stored position to the filling position.

In all three arrangements the apparatus preferably further comprises means for, in use, bringing into selective co-operation the opening of the flexible pouch and the required nozzle. Preferably the means for bringing into selective co-operation the opening of the flexible pouch and the required nozzle comprises providing relative vertical movement between said pouch and said nozzle thereby bringing them into contact with one another.

In one preferred arrangement the apparatus has a single fixed filling position to which the pouches are presented and at which the opening of the flexible pouch and the required nozzle are brought into selective co-operation.

Preferably, the apparatus comprises at least one source of diluent which may include a valve controlling flow of diluent from the source. In a preferred arrangement the apparatus comprises at least two sources of diluent, at least one of which is carbonated and one of which is un-carbonated. Preferably the apparatus includes a carbonator to carbonate one source of diluent.

In one preferred arrangement the means of introducing the diluent to the concentrate introduces said diluent immediately downstream of the concentrate pump.

In an alternative preferred arrangement the means of introducing the diluent to the concentrate introduces said diluent immediately prior to the nozzle.

Preferably, the apparatus further comprises a means for receiving a cartridge or bandolier containing a plurality of flexible pouches. More preferably the apparatus comprises means for receiving a plurality of cartridges or bandoliers containing a plurality of flexible pouches. Preferably the flexible pouches are interlinked so as to form a chain.

Preferably, flexible pouches from each cartridge or bandolier are fed to the filling position. In one preferred arrangement each bandolier or cartridge has its own fixed filling position. Preferably the filling positions are adjacent each other and the array of nozzles are movable such that each nozzle can be presented at any one of said fixed filling positions.

Preferably the apparatus comprises a means for opening a closure in said pouch prior to it being filled. In one preferred arrangement the means opening a closure comprises removing the cap from an opening in the pouch, preferably by unscrewing it. In an alternative preferred arrangement means for opening a closure comprises rotating or moving a first part of the closure respective a second part of the closure, the relative movement opening a flowpath therethrough.

According to a second aspect of the invention there is provided an apparatus in accordance with the first aspect of the invention in combination with a plurality of concentrate reservoirs, each having a concentrate pump and flexible conduit, terminating in a nozzle, associated therewith.

Preferably the concentrate pump, conduit and nozzle are disposable.

Preferably the concentrate pump, conduit and nozzle comprise a unitary component.

According to a third aspect of the invention there is provided an apparatus in accordance with the first or second aspect of the invention in combination with at least one cartridge or bandolier of flexible pouches.

Preferably each flexible pouch has a rigid spout comprising a mixing element. More preferably the mixing elements extend into the pouch.

In one preferred embodiment of the third aspect of the invention, the apparatus further comprising a controller, the controller configured to control the loading of a concentrate reservoir into the apparatus by driving the apparatus in the following steps:

a) controlling the apparatus to arrange a flexible pouch at the filling position; b) operating the driver to couple it with the concentrate pump; c) operating the driver to draw fluid into the concentrate pump to substantially fill pump cavities therein; d) continuing to operate the driver to pump fluid through the concentrate pump, flexible conduit and nozzle to substantially eliminate any air or other gasses from any of the cavities therein, the pumped fluid emitting into the flexible pouch; e) controlling the apparatus to sealingly close the flexible pouch; and f) releasing the flexible pouch for disposal.

In another preferred embodiment of the third aspect of the invention, the concentrate pump comprises at least one barrel having an inlet valve and an outlet valve associated therewith and a piston, movable within the barrel to change the enclosed volume of the barrel between a minimum and a maximum volume to draw fluid into, and pump fluid from, said barrel via said inlet valve and outlet valve respectively, and further comprises a controller, the controller configured to control the disengagement of a concentrate pump from the apparatus by driving the apparatus in the following steps:

a) controlling the apparatus to arrange a flexible pouch at the filling position; b) operating the driver to return each piston to its position wherein the enclosed volume of the barrel is substantially at its minimum thereby ejecting any fluid contained within the enclosed volume into the flexible pouch to substantially empty said concentrate pump; and c) operating the driver to de-couple the drive mechanism from the removable concentrate pump to allow for its removal.

Preferably the controller is further configured to:

d) operate the apparatus to sealingly close the flexible pouch; and e) release said flexible pouch for disposal.

In yet another preferred embodiment of the third aspect of the invention the concentrate pump comprises at least one barrel having an inlet valve and an outlet valve associated therewith and a piston, movable within the barrel to change the enclosed volume of the barrel between a minimum and a maximum volume to draw fluid into, and pump fluid from, said barrel via said inlet valve and outlet valve respectively, and further comprises a controller, the controller configured to control the changing of a concentrate reservoir driving the apparatus in the following steps:

a) operating, the apparatus to arrange a flexible pouch at the filling position; b) operating the driver to return each piston of a first concentrate pump to its position wherein the enclosed volume of the barrel is substantially at its minimum thereby ejecting any fluid contained within the enclosed volume into the flexible pouch to substantially empty said first concentrate pump; c) operating the driver to de-coupling itself from the first concentrate pump and associated concentrate reservoir enabling it to be removed and a concentrate reservoir and associated second concentrate pump to be inserted; d) operating the drive mechanism to couple the drive mechanism to the second concentrate pump; e) operating the drive mechanism to draw fluid into the second concentrate pump to substantially fill the cavities therein; f) operating the drive mechanism to pump fluid through the second concentrate pump to substantially eliminate any air or other gasses from the cavities therein, the fluids expelled from the second concentrate pump collecting in said flexible pouch; g) operating the apparatus to sealingly close the flexible pouch; and h) releasing the flexible pouch from the apparatus for disposal.

Preferably, subsequent to coupling the drive mechanism to the second concentrate pump and prior to sealingly closing the flexible pouch the controller is further configured to simultaneously operate the driver to pump concentrate through the concentrate pump to substantially eliminate any air or other gasses from the cavities therein, and control the diluent valve to add diluent into the pumped concentrate such that the downstream of the pump cavities, the flexible conduit and nozzle becomes primed with a diluted mixture of concentrate and diluent.

Preferably the controller is configured to operate the diluent valve such that sufficient mixture of concentrate and diluent are passed through the concentrate pump and into the flexible pouch such that the flexible conduit and nozzle are primed with a substantially homogeneous mixture of diluent and concentrate at a required concentrate:diluent ratio.

Preferably the removable concentrate pump has a diluent inlet downstream of its outlet valves and the controller is further configured to control the diluent valve such that, once both pistons are returned to the position wherein the enclosed volume of the barrels is substantially at its minimum, diluent is passed through the concentrate pump to substantially flush the concentrate from the flexible conduit and nozzle, downstream of the diluent inlet, into the flexible pouch.

In a further preferred embodiment of the third aspect of the invention, wherein the dispenser has a supply of carbonated diluent and a supply of non carbonated diluent, the controller is configured to control dispense of a carbonated beverage into a flexible pouch in the following steps:

a) controlling the apparatus to arrange a flexible pouch at the filling position; b) operating the driver to pump fluid through the concentrate pump; c) introducing carbonated diluent to the concentrate flow downstream of the concentrate pump and upstream of the flexible conduit, such that the pouch is filled; via the flexible conduit, with a diluted carbonated beverage; d) prior to completion of the dispense, controlling the apparatus to stop the flow of carbonated diluent and to start a flow of non-carbonated diluent such that at least the flexible conduit becomes filled with non carbonated diluted concentrate; e) controlling the apparatus to stop the flow of concentrate and non carbonated diluent; f) controlling the apparatus to sealingly close the flexible pouch; and g) releasing the flexible pouch.

In this way, after dispensing a carbonated beverage into the pouch, the residual fluid left in the flexible conduit is non carbonated. This helps to prevents drips from the nozzle as, were the flexible conduit left with residual carbonated fluid therein, over time the dissolved gasses would break out of the fluid and expand in volume thereby forcibly ejecting fluid out of the nozzle.

According to a fourth aspect of the invention there is provided a method of loading a concentrate reservoir into the apparatus according to the third aspect of the invention comprising the steps of:

a) aligning the nozzle of the concentrate reservoir with the filling position; b) arranging a flexible pouch at the filling position; c) coupling the drive mechanism to the concentrate pump; d) operating the driver to draw fluid into the concentrate pump to substantially fill pump cavities therein; e) pumping fluid through the concentrate pump, flexible conduit and nozzle to substantially eliminate any air or other gasses from cavities therein; f) collecting any fluids expelled from the nozzle in said flexible pouch; g) sealingly closing the flexible pouch; and h) disposing of said flexible pouch.

Preferably the concentrate pump has a diluent inlet downstream of the pump cavities and the method further comprises the step of, simultaneously operating the drive mechanism to pump concentrate through the concentrate pump to substantially eliminate any air or other gasses from the cavities therein, adding diluent into the pumped concentrate such that, downstream of the pump cavities, the flexible conduit and nozzle becomes primed with a diluted mixture of concentrate and diluent.

Preferably sufficient mixture of concentrate and diluent is passed through the concentrate pump and into the flexible pouch such that the flexible conduit and nozzle are primed with a substantially homogeneous mixture of diluent and concentrate at a required concentrate:diluent ratio.

According to a fifth aspect of the invention there is provided a method of disengaging a concentrate pump from an apparatus according to the third aspect of the invention, the concentrate pump comprising at least one barrel having an inlet valve and an outlet valve associated therewith and a piston, movable within the barrel to change the enclosed volume of the barrel between a minimum and a maximum volume to draw fluid into, and pump fluid from, said barrel via said inlet valve and outlet valve respectively, said method comprising the steps of:

a) aligning the nozzle associated with the concentrate pump with the filling position; b) arranging a flexible pouch at the filling position; c) returning each piston to its position wherein the enclosed volume of the barrel is substantially at its minimum thereby ejecting any fluid contained within the enclosed volume into the flexible pouch to substantially empty said concentrate pump; d) de-coupling the drive mechanism from the concentrate pump; and e) removing the substantially empty concentrate pump from the drive mechanism.

In a preferred arrangement the method further includes the steps of:

f) sealingly closing the flexible pouch; and g) disposing of said flexible pouch.

Preferably the concentrate pump has a diluent inlet downstream of its outlet valves and the method further comprises the step of, once both pistons are returned to the position wherein the enclosed volume of the barrels is substantially at its minimum, passing diluent through the concentrate pump to substantially flush the pumped fluid from the flexible conduit and nozzle, downstream of the diluent inlet, into the flexible pouch.

According to a sixth aspect of the invention there is provided a method of changing a concentrate pump of the third aspect of the invention, the concentrate pump comprising at least one barrel having an inlet valve and an outlet valve associated therewith and a piston, movable within the barrel to change the enclosed volume of the barrel between a minimum and a maximum volume to draw fluid into, and pump fluid from, said barrel via said inlet valve and outlet valve respectively, said method comprising the steps of:

a) aligning the nozzle of the concentrate reservoir with the filling position; b) arranging a flexible pouch at the filling position; c) returning each piston to its position wherein the enclosed volume of the barrel is substantially at its minimum thereby ejecting any fluid contained within the enclosed volume into the flexible pouch to substantially empty said first concentrate pump; d) de-coupling the drive mechanism from the first concentrate pump; e) removing the substantially empty first concentrate pump from the drive mechanism; f) inserting a second concentrate pump into the drive mechanism; g) coupling the drive mechanism to the second concentrate pump; h) operating the drive mechanism to draw fluid into the second concentrate pump to substantially fill the cavities therein; i) operating the drive mechanism to pump fluid through the second concentrate pump to substantially eliminate any air or other gasses from the cavities therein; j) collecting any fluids expelled from the second concentrate pump in said flexible pouch; k) sealingly closing the flexible pouch; and l) disposing of said flexible pouch.

Preferably the concentrate pump has a diluent inlet downstream of the outlet valves and the method further comprises the step of, once both pistons are returned to the position wherein the enclosed volume of the barrels is substantially at its minimum, passing diluent through the concentrate pump to substantially flush any concentrate downstream of the concentrate pump through the flexible conduit and nozzle and into the flexible pouch.

Preferably the concentrate pump has a diluent inlet downstream of the outlet valves and the method further comprises the step of, simultaneously to operating the drive mechanism to pump concentrate through the concentrate pump to substantially eliminate any air or other gasses from any the cavities therein, adding diluent into the pumped concentrate such that, downstream of the diluent inlet, the pump, flexible conduit and nozzle become primed with a diluted mixture of concentrate and the diluent.

Preferably sufficient mixture of concentrate and diluent is passed through the concentrate pump and into the flexible pouch such that the flexible conduit and nozzle are primed with a substantially homogeneous mixture of diluent and concentrate at the required diluent:concentrate ratio.

By operating in the method as described in relation the fourth, fifth and sixth aspects of the invention, a reservoir of concentrate, together with its associated concentrate pump, flexible conduit and nozzle, can be removed and/or inserted ready for use in a manner in which any waste fluids emitted from the apparatus as a result thereof are captured in a flexible pouch which is then sealed and disposed of. In this manner a reservoir of concentrate, together with its associated concentrate pump, flexible conduit and nozzle can be changed in a clean manner.

According to a seventh aspect of the invention there is provided a flexible pouch for containing a liquid comprising at least two sides of flexible material, sealed along their edges to form a pouch and a rigid spout in an opening of the container, wherein said spout comprises a mixing element to assist the mixing of any fluid entering said flexible pouch via said spout.

Preferably the mixing element extends into said pouch.

BRIEF DESCRIPTION OF THE DRAWINGS

Embodiments of the invention will now be described in detail, by way of example, with reference to the following drawings in which.

DETAILED DESCRIPTION

Figure 1:
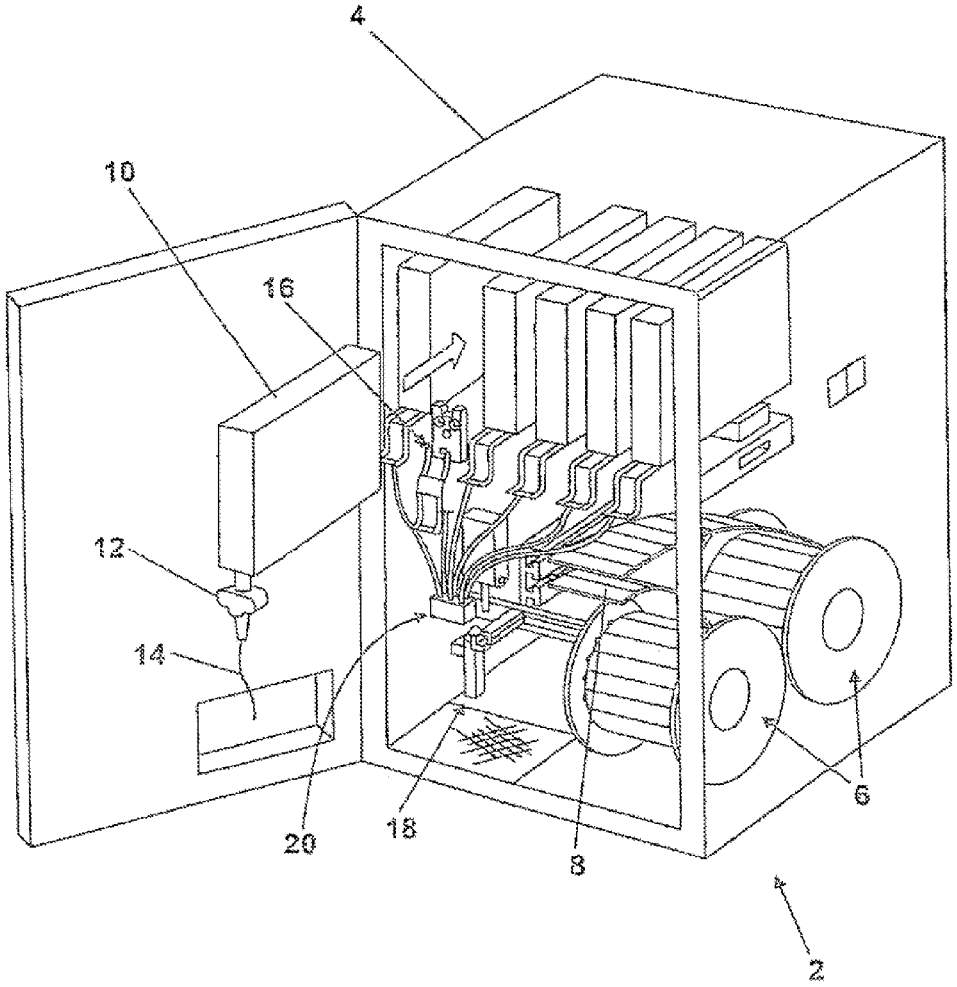
FIG. 1 is a perspective view of the apparatus with the door open.
Figure 2:
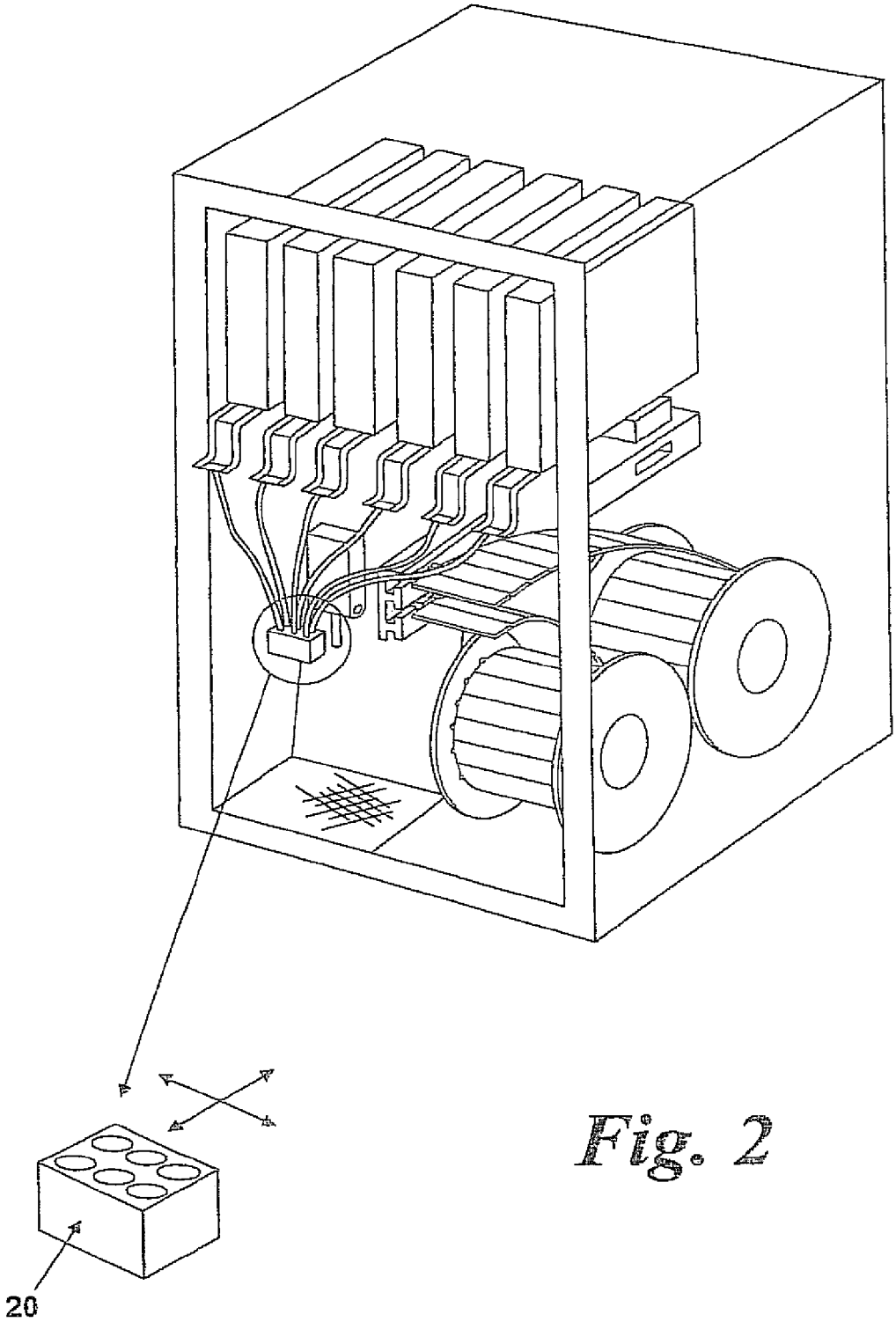
FIG. 2 is a perspective view of the apparatus showing detail of the nozzle block.

Referring to the FIGS. 1 and 2 a dispenser 2 is shown comprising an enclosure 4 containing two bandoliers 6 of flexible pouches 8, the bandoliers 6 are led so as to present the flexible pouches 8 at a pick up point. The bandoliers 6 may contain the same sized pouches 8 or alternatively the bandoliers 6 may each contain pouches 8 of a different size. Also within the enclosure are a plurality of concentrate containers 10 containing different flavoured beverage concentrates and attached to each container is a removable pump 12 which is advantageously disposable. Each disposable pump has a water inlet and a mixer attached thereto, the water being added to the pumped concentrate and mixed therewith in the mixer. Leading from each disposable pump 12 is a flexible conduit 14 terminating in a nozzle through which the mixed beverage can be dispensed. The pump, mixer, flexible conduit and nozzle are all disposable. Each disposable pump 12 has associated therewith a pump driver 16 which is a permanent part of the dispenser. The pump driver 16 operates at the required speed to create a ratiometric mix of concentrate to water to dispense a beverage of the required concentration. The water flow through the machine has a control valve to control the flow of water and a flow sensor to measure the flow of water thereto. The signal, indicative of the water flow, is used to control the speed of the pump driver 16 to achieve the required concentrate:diluent ratio.

Each flexible pouch has an opening therein containing a rigid spout having a removable screw cap thereover. A mechanical arm 18 grips the rigid spout, detaches a flexible pouch from the bandolier, and moves it to a location where the cap is gripped and unscrewed. The pouch, without its top may then be moved to a filling position. The filling position and the cap removal location may be one and the same; this removes the necessity of moving a full pouch without a cap on between the two and therefore reduces the risk of contamination due to spills.

The dispenser has a nozzle block 20 which receives the nozzles from the various concentrate containers, the nozzles forming an array. The nozzle block 20 is movable so as to enable the required nozzle to be moved adjacent the open top of the spout of the flexible pouch 8. As shown the nozzle block 20 forms a three by two array and is indexable in two directions X, Y. The nozzles protrude through the base of the nozzle block 20 so when the required nozzle is positioned above the flexible pouch 8 in its filling position, the pouch 8 can be moved so that its spout abuts the end of the nozzle such that when the pouch is filled via the nozzle the beverage only contacts the nozzle and the pouch, not any non disposable parts of the dispenser. In this way a sanitary dispenser can be achieved. Different arrays, e.g. four by two, six by one or rotary may of course be substituted for the array shown in FIG. 2 without departing from the invention.

When the pouch and nozzle are abutting one another the pump actuator pumps beverage concentrate and the water valve opens to dilute the concentrate. The diluent and concentrate pass through the mixer and flexible conduit 14 and exit the nozzle directly into the flexible pouch 8. The flexible pouches 8 are stored with their sides flat against one another on the bandolier 6 and open when the beverage enters via the spout. In this manner there is negligible air within the pouch prior to filling and as such no venting of the pouch is required as it fills with beverage. When the pouch 8 is full the water control valve shuts and the pump actuator stops thereby halting the flow of beverage into the pouch. The pouch is then either moved to the lid-off station where the lid is replaced on the spout and screwed so as to form a seal, or alternatively, if the lid-off station and filling station are one and the same, the nozzle block 20 is moved clear of the top of the pouch and the lid replaced. Once the full pouch has been sealed by replacement of the lid it can be dispensed from the dispenser 2 via a chute.

The concentrate reservoir, pump, mixer, flexible conduit and nozzle form one unit which is placed in the machine. The pump assembly comprising pump, mixer, conduit and nozzle forms one integral disposable part which is disposed of each time the concentrate reservoir is changed. The pump assembly and the concentrate reservoir may be supplied as one unitary piece or alternatively may be attached to one another before being inserted into the dispenser. The pump may be of a known type, for example a diaphragm pump or alternatively may be a piston pump as described below.

Figure 3:
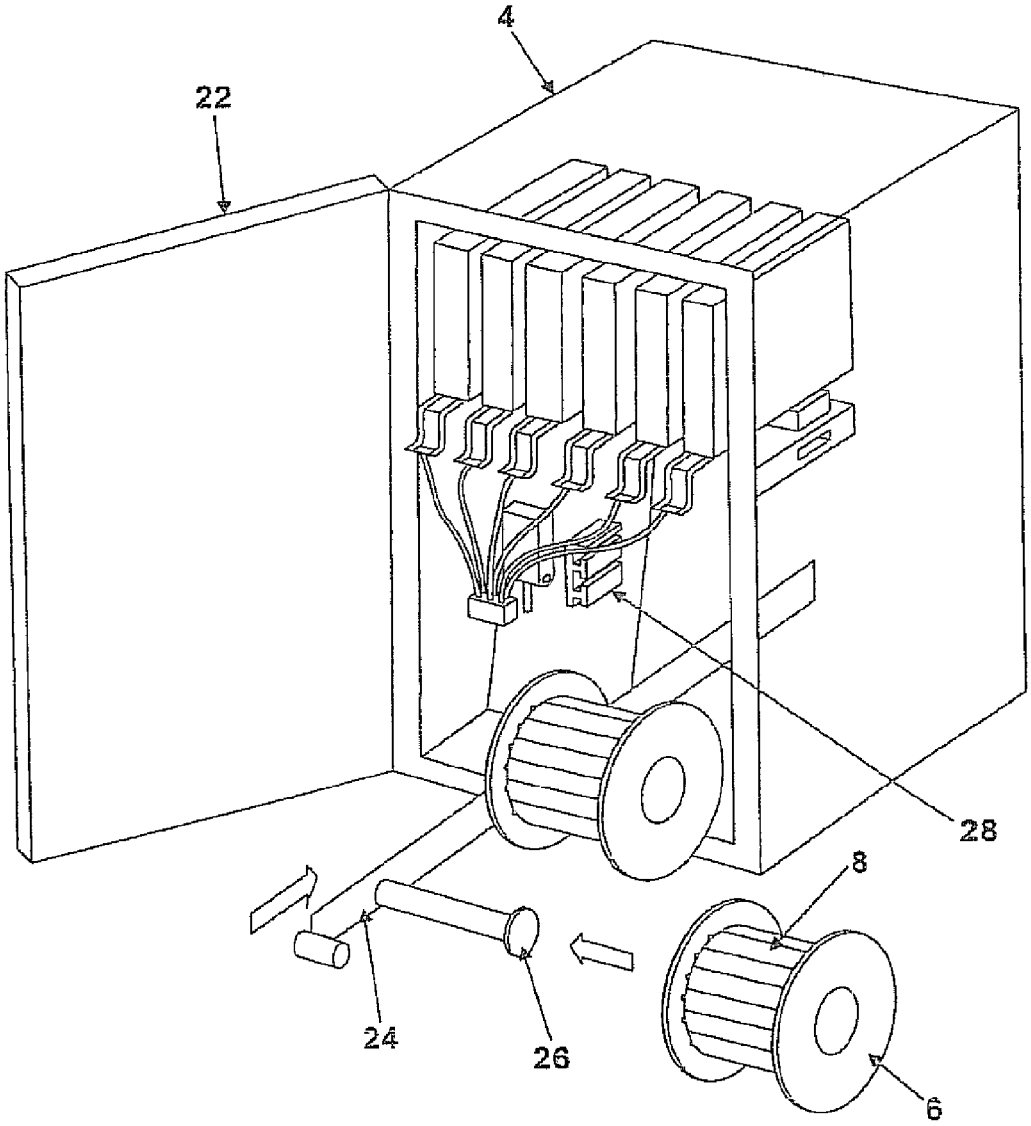
FIG. 3 is a perspective view of the apparatus with the door open showing how the bandolier of flexible pouches are loaded.

Referring to FIG. 3, when the door 22 is open a slide 24 enables the bandolier 6 of pouches 8 to be slid forwards out of the enclosure 4. The bandolier 6 is then simply slid off an axis 26 on which it is held and a replacement slid on. The slide 24 is then pushed back into the enclosure 4 and the end of the bandolier 6 of pouches 8 is fed into a guide 28 from which one can be selected to be filled.

Figure 4:
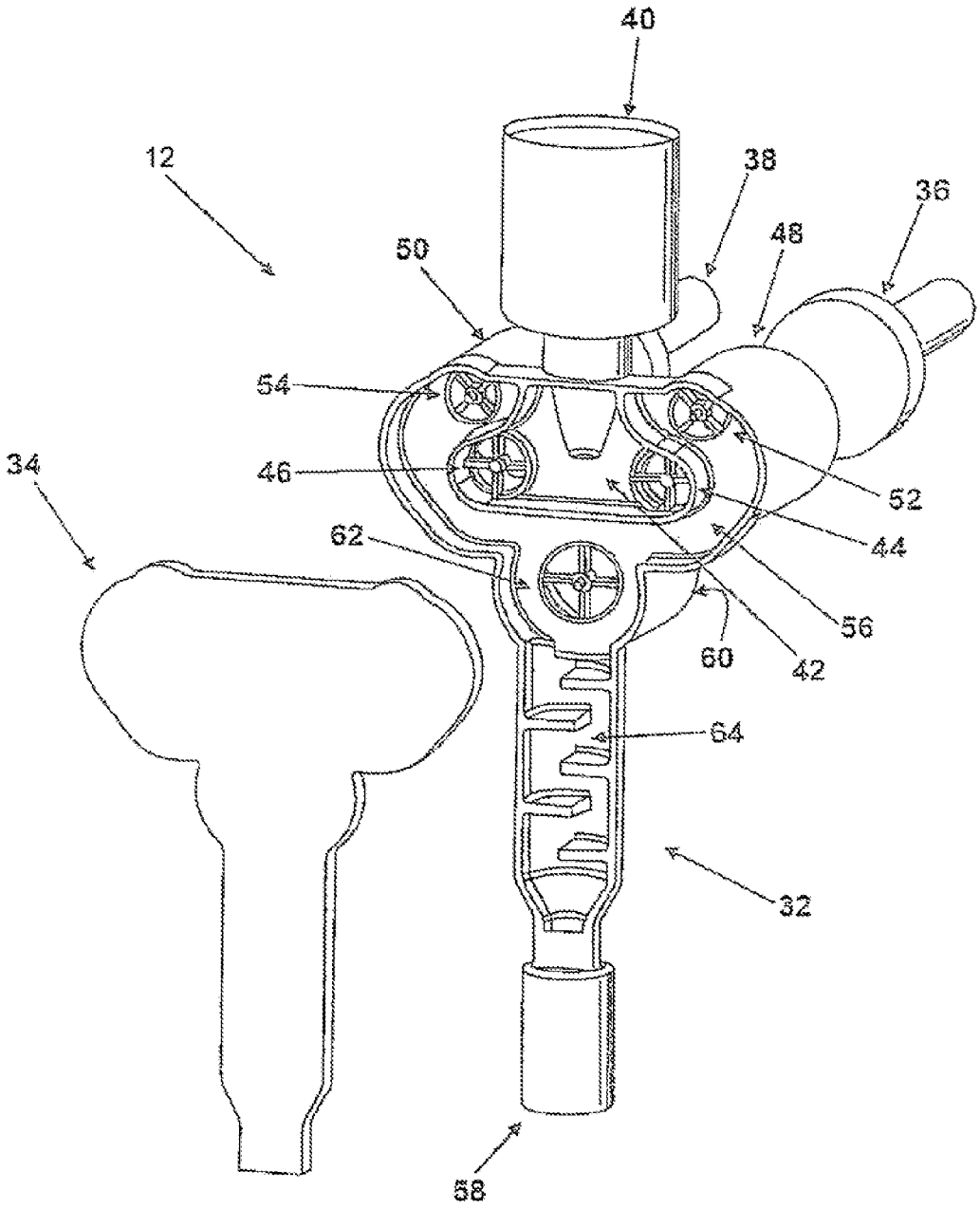
FIG. 4 is an exploded view of a pump cartridge for use in the invention without the flexible conduit.

Referring to FIG. 4 an exploded view of a removable pump unit 12 is shown. The unit 12 is manufactured of a number of parts: a body section 32, a cover section 34 (which may be integral to the body section moulding), two pistons 36, 38 and valve closures (omitted for clarity). The body section 32 is a simple plastics moulding of a suitable material, for example low density polypropylene or medium or low density polyethylene (alternative longer lasting materials, for example metal could be used in situations where the pump was intended to be reusable but not removable). The cover 34 is ultrasonically welded to the body section 32 so as to enclose an open face thereof. The body section comprises an inlet 40 connected in use to a reservoir containing the substance to be pumped. The inlet 40 opens into an inlet valving chamber 42 from which two inlet valves 44, 46 lead into the end faces of the barrels 48, 50 of the pump unit 12. The pump barrels 48, 50 each have a piston 36, 38 therein. At the highest most position on the end face of each barrel 48, 50 is situated an outlet valve 52, 54 leading from the barrels 48, 50 into an outlet valve chamber 56. By placing the outlet valves 52, 54 at the very top of the barrels and having them situated above the inlet valves 44, 46 the system is essentially self bleeding as any air within the barrels 48, 50 will rise to the top of the barrel and be expelled therefrom via the outlet valves 52, 54 and dead space in which air can collect at the top of the barrels is avoided. As the volume of air trapped in any dead space will vary from use to use, and even from stroke to stroke, good priming and eliminating dead space enables a highly repeatable pump to be effected. The inlet valves 44, 46 and the outlet valves 52, 54 are umbrella or flap type check valves and allow flow in the direction from the inlet 46 to the outlet 58 but not in the reverse direction. The pump unit 12 has a diluent inlet 60 to which diluent can be supplied. Situated in the mouth of the diluent inlet 60 is a diluent check valve 62 to prevent flow of concentrate from the barrels 48, 50 into the diluent inlet. In addition the check valve operates to prevent drips from the pump via the diluent inlet when the pump is disconnected from the machine. The fluid being pumped, i.e. the beverage concentrate, and the diluent mix in the outlet valve chamber 56 and pass together through a static mixer 64 before exiting the pump unit 30 via the outlet 58.

Figure 5:
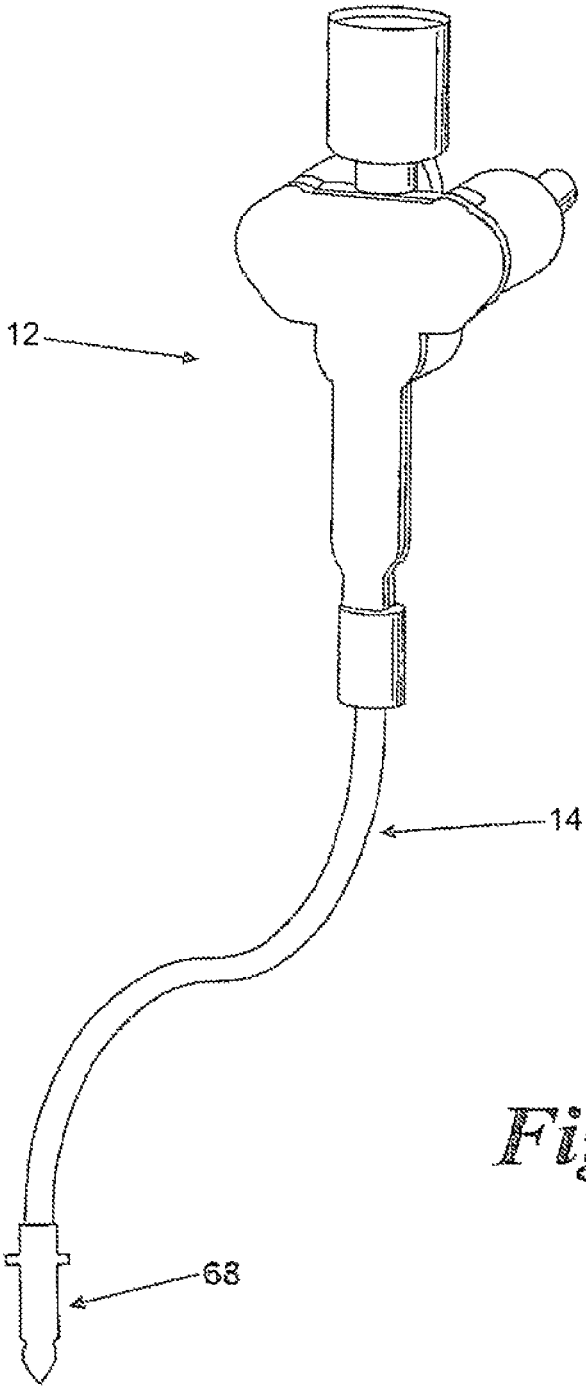
FIG. 5 is a perspective view of a pump cartridge for use in the invention.

Referring to FIG. 5 a pump 12 with a unitary flexible conduit 66 and nozzle 68 is shown. The pump is suitable for use in the dispenser shown in FIGS. 1 to 3 and the nozzle is adapted to fit into a multiple dispense head as shown in FIG. 3.

Referring to FIGS. 1 to 5, when it is required to load a concentrate reservoir 10 with associated pump 12, flexible conduit 14 and nozzle 68 onto the dispenser 2 then the dispenser places a flexible pouch 8 at the filling position for alignment with the nozzle. The concentrate reservoir 10 is placed in situ and the concentrate pump 12 and nozzle 68 are located in their desired positions. It will be noted that the flexible pouch 8 may be located at the filling point prior to, or after, the nozzle 68 of the concentrate reservoir 10 is located in the nozzle block 20.

The pump driver 16 is then operated to engage the concentrate pump 12 and to reciprocate the pistons 36, 38 thereof such that fluid is drawn into the pump barrels 48, 50 via the inlet valves 44, 46 at the bottom of the end face of the piston barrels 48, 50 and ejected via the outlet valves 52, 54 at the top of the pump barrels 48, 50. In this manner any air trapped in the barrels will rise to the top and be ejected via the outlet valves 52, 54 thereby priming the concentrate pump 12. Prior to use for dispensing a volumetric amount from the concentrate pump 12, the pistons 36, 38 are reciprocated sufficiently to substantially eliminate all the air from the pump bands 52, 54 and valve areas. Any concentrate that passes through the pump 12 during this priming process passes through the flexible conduit 14 and nozzle 68 and is collected in the flexible pouch 8 positioned at the filling position. During this priming process diluent is supplied into the concentrate pump 12 via the diluent inlet 60 to admix with the concentrate. Sufficient concentrate and diluent are passed through the concentrate pump 12 in the priming process that any fluid retained in the pump 12, flexible conduit 14 or nozzle 68, downstream of the diluent inlet 60, is substantially at the required ratio of concentrate to diluent. Again any fluid passing through the concentrate pump 12, flexible conduit 14 and nozzle 68 to achieve this is collected in the flexible pouch 8. In this manner when the flexible pouch 8 is removed, the dispenser 2 is ready to pump the required product at the required ratio without the inclusion of any substantial amounts of air.

When it is required to remove an empty or partially empty concentrate reservoir 10, with associated pump 12, flexible conduit 14 and nozzle 68, from the dispenser then a flexible pouch 8 is presented at the filling position for alignment with the nozzle 68 prior to the disengagement of the pump driver 16 from the piston 36, 38.

The pump driver 16 is then operated to disengage from the concentrate pump 12. As the pistons 36, 38 are driven forward during the disengagement process an amount of concentrate contained in the pump will be driven out of the pump barrels 48, 50, down the flexible conduit 14 and out the nozzle 68 to be collected in the flexible pouch 8. Prior to removal of the concentrate pump 12 from the dispenser 2, diluent is pumped through the diluent inlet 60 and into the flexible pouch 8 via the flexible conduit 14 and nozzle 68 to flush any concentrate therefrom. This process removes any concentrate from the concentrate pump 12, conduit 14 and nozzle 68 leaving them containing diluent which, in case of drips, is easier to clean. After the concentrate pump 12 has been removed the flexible pouch 8 may be sealed, removed and disposed of. Alternatively if the removed concentrate reservoir 10 and associated pump 12, conduit 14 and nozzle 68 are being replaced, flexible pouch 8 may be left in position and the same flexible pouch 8 used to collect any fluids passing through the new concentrate pump during the engagement and priming process as described above. The apparatus has a controller (omitted for clarity) of a known type, for example a micro-controller, associated with it programmed to control the various components of the apparatus, both during normal operation and to perform the apparatus functions during the steps of loading and unloading of concentrate reservoirs.

Figure 6:
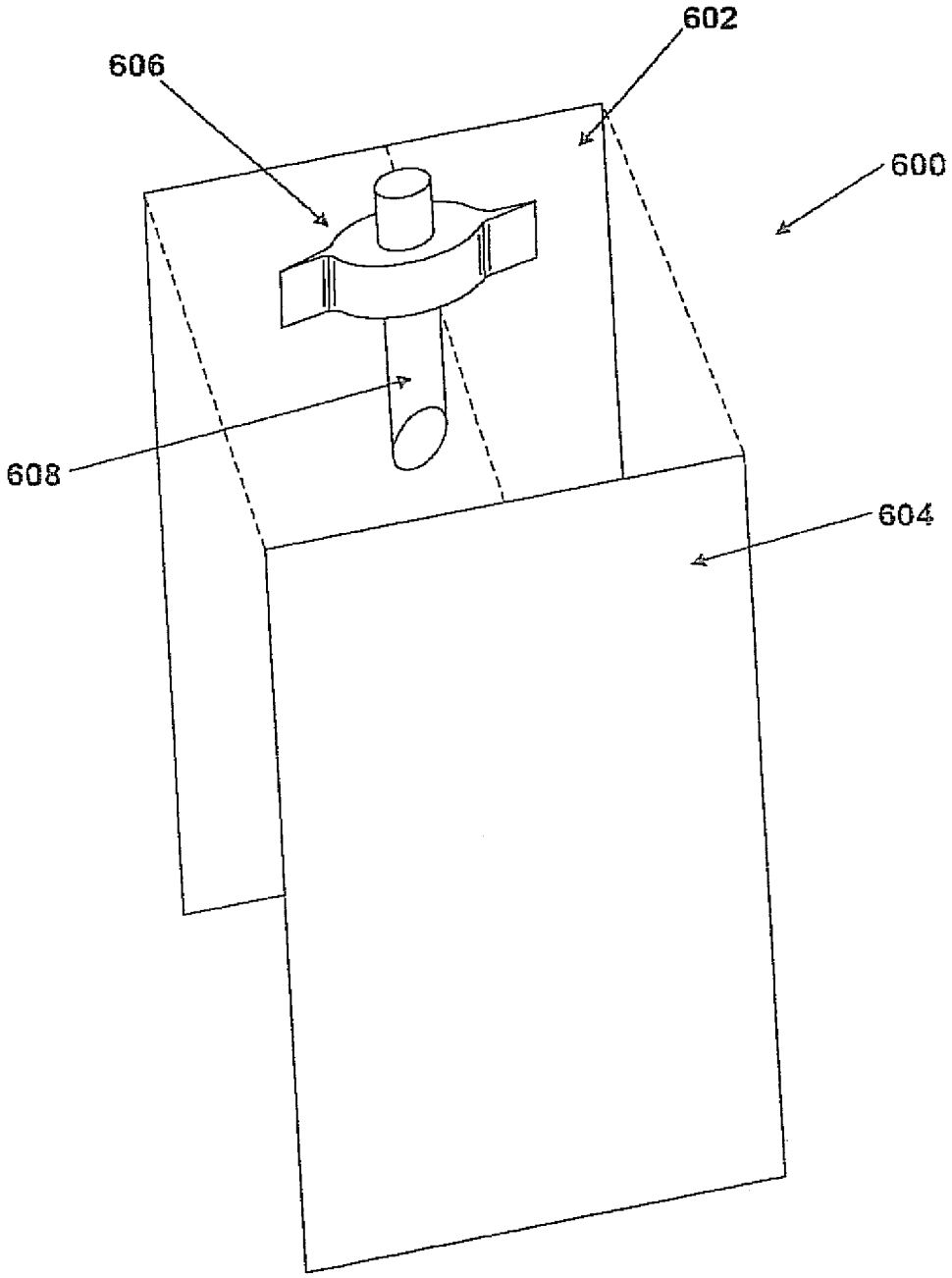
FIG. 6 is a pouch according to the seventh aspect of the invention.

Referring to FIG. 6 a pouch 600 is shown comprising first 602 and second 604 panels made of a flexible material. The panels are attached to one another around their peripheral edges to form a pouch. During the forming process, spout 606 is inserted between the edges of the panels so as to become fixed therebetween. Traditional fixing methods such as heat welding are used to attach the panels. The spout 606 has a mixing element 608 extending therefrom into the interior of the pouch 600, when formed. The mixing element 608 comprises a channel having a torturous flowpath therein causing turbulence of fluid entering the pouch via the spout. The two panels may comprise sections of a single panel attached along one edge.

The invention claimed is:

1. A method of dispensing a beverage, the method comprising:

providing a housing having a plurality of reservoirs of beverage concentrate each reservoir having a concentrate pump and flexible conduit terminating in a nozzle;

providing a plurality of drivers driving said concentrate pumps;

mixing a diluent with the beverage concentrate to produce a beverage;

providing a multiple dispense head accepting the plurality of nozzles;

aligning one of the plurality of nozzles at a filling position;

selecting a flexible pouch and bringing it to the filling position where it is filled via an opening;

closing said opening and dispensing said flexible pouch;

wherein the filling position is a fixed position and wherein said nozzles are movable relative to the filling position such that any one of said plurality of nozzles can be presented at said filling position; and providing at least one cartridge or bandolier of flexible pouches;

said method further comprising:

aligning the nozzle with the filling position;

positioning the flexible pouch at the filling position;

coupling a pump driver to the concentrate pump;

operating the pump driver to draw fluid into the concentrate pump to substantially fill pump cavities therein;

pumping fluid through the concentrate pump, flexible conduit and nozzle to substantially eliminate any air or other gasses from any of the cavities therein;

collecting any fluid expelled from the nozzle in said flexible pouch;

sealingly closing the flexible pouch; and disposing of said flexible pouch.

2. The method of dispensing a beverage of claim 1 wherein subsequent to coupling the pump driver to a second concentrate pump and prior to sealingly closing the flexible pouch the method further comprises, simultaneously operating the pump driver to pump concentrate through the concentrate pump to substantially eliminate any air or other gasses from the cavities therein, adding diluent into the pumped concentrate such that the downstream of the pump cavities, the flexible conduit and nozzle becomes primed with a diluted mixture of concentrate and diluent.

3. The method of dispensing a beverage of claim 2 wherein sufficient mixture of concentrate and diluent are passed through the concentrate pump and into a receptacle such that the flexible conduit and nozzle are primed with a substantially homogeneous mixture of diluent and concentrate at a required concentrate:diluent ratio.

4. A method of dispensing a beverage, the method comprising:

providing a housing having a plurality of reservoirs of beverage concentrate each reservoir having a concentrate pump and flexible conduit terminating in a nozzle;

providing a plurality of drivers driving said concentrate pumps;

mixing a diluent with the beverage concentrate to produce a beverage;

providing a multiple dispense head accepting the plurality of nozzles;

aligning one of the plurality of nozzles at a filling position;

selecting a flexible pouch and bringing it to the filling position where it is filled via an opening;

closing said opening and dispensing said flexible pouch;

wherein the filling position is a fixed position and wherein said nozzles are movable relative to the filling position such that any one of said plurality of nozzles can be presented at said filling position;

providing at least one cartridge or bandolier of flexible pouches;

wherein the concentrate pump includes at least one barrel having an enclosed volume, an inlet valve and an outlet valve associated therewith, and a piston, movable within the barrel to change the enclosed volume of the barrel between a minimum and a maximum volume to draw fluid into, and pump fluid from, said barrel via said inlet valve and outlet valve respectively, said method further comprising:

a) aligning the nozzle associated with the concentrate pump with the filling position; b) arranging a flexible pouch at the filling position; c) returning each piston to its position wherein the enclosed volume of the barrel is substantially at its minimum thereby ejecting any fluid contained within the enclosed volume into the flexible pouch to substantially empty said concentrate pump; d) de-coupling the pump driver from the removable concentrate pump; and e) removing the substantially empty the concentrate pump from the pump driver.

5. The method of dispensing a beverage of claim 4 further comprising the steps of: f) sealingly closing the flexible pouch; and g) disposing of said flexible pouch.

6. The method of dispensing a beverage of claim 4 wherein the concentrate pump has a diluent inlet downstream of its outlet valves and the method further comprises, once both pistons are returned to the position wherein the enclosed volume of the barrels is substantially at its minimum, passing diluent through the concentrate pump to substantially flush the concentrate from the flexible conduit and nozzle, downstream of the diluent inlet, into the flexible pouch.

7. A method of dispensing a beverage, the method comprising:

providing a housing having a plurality of reservoirs of beverage concentrate each reservoir having a concentrate pump and flexible conduit terminating in a nozzle;

providing a plurality of drivers driving said concentrate pumps;

mixing a diluent with the beverage concentrate to produce a beverage;

providing a multiple dispense head accepting the plurality of nozzles;

aligning one of the plurality of nozzles at a filling position;

selecting a flexible pouch and bringing it to the filling position where it is filled via an opening;

closing said opening and dispensing said flexible pouch;

wherein the filling position is a fixed position and wherein said nozzles are movable relative to the filling position such that any one of said plurality of nozzles can be presented at said filling position;

providing at least one cartridge or bandolier of flexible pouches;

wherein the concentrate pump includes at least one barrel having an enclosed volume, an inlet valve and an outlet valve associated therewith, and a piston, movable within the barrel to change the enclosed volume of the barrel between a minimum and a maximum volume to draw fluid into, and pump fluid from, said barrel via said inlet valve and outlet valve respectively, said method further comprising:

a) aligning the nozzle of the concentrate reservoir with the filling position; b) arranging a flexible pouch at the filling position; c) returning each piston of a first concentrate pump to its position wherein the enclosed volume of the barrel is substantially at its minimum thereby ejecting any fluid contained within the enclosed volume into the flexible pouch to substantially empty said first concentrate pump; d) de-coupling the pump driver from the first concentrate pump; e) removing the substantially empty first concentrate pump from the pump driver; f) inserting a second concentrate pump into the pump driver; g) coupling the pump driver to the second concentrate pump; h) operating the pump driver to draw fluid into the second concentrate pump to substantially fill the cavities therein; i) operating the pump driver to pump fluid through the second concentrate pump to substantially eliminate any air or other gasses from the cavities therein; j) collecting any fluids expelled from the second concentrate pump in said flexible pouch; k) sealingly closing the flexible pouch; and l) disposing of said flexible pouch.

8. The method of dispensing a beverage of claim 7 wherein subsequent to coupling the pump driver to the second concentrate pump and prior to sealingly closing the flexible pouch the method further comprises, simultaneously operating the pump driver to pump concentrate through the concentrate pump to substantially eliminate any air or other gasses from the cavities therein, adding diluent into the pumped concentrate such that the flexible conduit and nozzle become primed with a diluted mixture of concentrate and diluent.

9. The method of dispensing a beverage of claim 8 wherein sufficient mixture of concentrate and diluent are passed through the concentrate pump and into a receptacle such that the flexible conduit and nozzle are primed with a substantially homogeneous mixture of diluent and concentrate at a required concentrate:diluent ratio.

10. A method of dispensing a beverage, the method comprising:

providing a plurality of containers that contain beverage concentrate, the plurality of containers having a plurality of pumps, a plurality of nozzles and a plurality of flexible conduits that connect the plurality of pumps to the plurality of nozzles;

selecting a first container in the plurality of containers, the first container having a first pump, a first nozzle and a first flexible conduit that connects the first pump to the first nozzle;

coupling a first pump driver to the first pump, the first pump driver being configured to drive the first pump;

providing a multiple dispense head that retains the plurality of nozzles;

providing a plurality of flexible pouches that each have an opening;

moving a first flexible pouch in the plurality of flexible pouches to a fixed filling position;

moving the multiple dispense head until the first nozzle is aligned with the opening in the first flexible pouch;

operating the first pump driver to pump fluid through the first pump, the first flexible conduit, and the first nozzle to thereby discharge the fluid to the first flexible pouch;

wherein operating the first pump driver and first pump substantially fills the first pump, the first flexible conduit and the first nozzle and thereby removes substantially all air from the first pump, the first flexible conduit and the first nozzle;

closing the opening of the first flexible pouch; and disposing of the first flexible pouch.

11. The method according to claim 10, further comprising prior to closing the opening of the first flexible pouch:

selecting a second container in the plurality of containers, the second container having a second pump, a second nozzle and a second flexible conduit that connects the second pump to the second nozzle;

coupling a second pump driver to the second pump, the second pump driver being configured to drive the second pump; and operating the second pump driver to pump a mixture of beverage concentrate and diluent through the second pump, second nozzle and second flexible conduit to the first flexible pouch to thereby prime the second pump, second nozzle and second flexible conduit with the mixture of beverage concentrate and diluent.

12. The method according to claim 11, further comprising operating the second pump driver to pump an amount of the mixture of beverage concentrate and diluent that is necessary to prime the second pump, second nozzle and second flexible conduit with a substantially homogenous mixture of beverage concentrate and diluent.

13. A method of dispensing a beverage, the method comprising:

providing a plurality of containers that contain beverage concentrate, the plurality of containers having a plurality of pumps, a plurality of nozzles and a plurality of flexible conduits that connect the plurality of pumps to the plurality of nozzles;

selecting a first container in the plurality of containers, the first container having a first pump, a first nozzle and a first flexible conduit that connects the first pump to the first nozzle;

coupling a first pump driver to the first pump, the first pump driver being configured to drive the first pump;

wherein the first pump comprises at least one barrel having an enclosed volume, an inlet valve, an outlet valve, and a piston that is movable in the barrel to draw fluid into the barrel via the inlet valve and alternately to pump fluid from the barrel via the outlet valve;

coupling a first pump driver to the first pump, the first pump driver being configured to drive the first pump;

providing a multiple dispense head that retains the plurality of nozzles;

providing a plurality of flexible pouches that each have an opening;

moving a first flexible pouch in the plurality of flexible pouches to a fixed filling position;

moving the multiple dispense head until the first nozzle is aligned with the opening in the first flexible pouch;

operating the first pump driver to substantially empty the first pump by moving the piston in the barrel to pump fluid from the barrel via the outlet valve, and through the pump, respective flexible conduit, and first nozzle, and into the first flexible pouch; and de-coupling the first pump driver from the first pump.

14. The method according to claim 13, further comprising closing the opening of the first flexible pouch; and disposing of the first flexible pouch; wherein operating the respective pump driver and respective pump substantially fills the pump, the respective flexible conduit and the first nozzle to remove air therefrom.

15. The method according to claim 13, further comprising:

selecting a second container in the plurality of containers, the second container having a second pump, a second nozzle and a second flexible conduit that connects the second pump to the second nozzle;

coupling a second pump driver to the second pump, the second pump driver being configured to drive the second pump; and operating the second pump driver to pump a mixture of beverage concentrate and diluent through the second pump, second nozzle and second flexible conduit to the first flexible pouch to thereby prime the second pump, second nozzle and second flexible conduit with the mixture of beverage concentrate and diluent.

16. The method according to claim 15, further comprising operating the second pump driver to pump an amount of the mixture of beverage concentrate and diluent that is necessary to prime the second pump, second nozzle and second flexible conduit with a substantially homogenous mixture of beverage concentrate and diluent.

* * * * *